United States Patent [19]

Yaniv

[11] Patent Number: 4,634,146

[45] Date of Patent: Jan. 6, 1987

[54] INSTRUCTION MANUAL AND METHOD OF USING INSTRUCTION MANUAL

[75] Inventor: Meir Yaniv, Yonkers, N.Y.

[73] Assignee: Crystal Technologies Corporation, Elmsford, N.Y.

[21] Appl. No.: 675,826

[22] Filed: Nov. 28, 1984

[51] Int. Cl.[4] ..... B42D 1/00; B42D 15/00

[52] U.S. Cl. ..... 281/15 R; 281/38; 283/67; 283/36; 283/43; 402/79

[58] Field of Search ..... 281/1, 3 R, 15 R, 38; 283/1 R, 67, 36, 43; 402/79; 434/109, 347

[56] References Cited

U.S. PATENT DOCUMENTS

| | | | |
|---|---|---|---|
| 867,316 | 10/1907 | Sperry | 281/38 |
| 1,172,010 | 2/1916 | Cooke | 402/79 |

FOREIGN PATENT DOCUMENTS

| | | | |
|---|---|---|---|
| 2423345 | 4/1979 | France | 281/1 |
| 473 | of 1909 | United Kingdom | 283/1 R |
| 133890 | 10/1919 | United Kingdom | 281/38 |
| 534406 | 1/1940 | United Kingdom | 281/3 R |
| 537845 | 7/1941 | United Kingdom | 402/79 |

*Primary Examiner*—Paul A. Bell

*Attorney, Agent, or Firm*—Frishauf, Holtz, Goodman & Woodward

[57] ABSTRACT

An instruction manual as a plurality of chapters, each chapter having a plurality of sections, the pages of the chapters being arranged in a first binder of a different size. At least one of the sections of the chapters comprises a personal reference section made up of pages of different size than the pages of the other sections of the chapters, and containing practical operational information concerning a feature of the equipment to which the instruction manual is directed. The pages of the different size personal reference section of the chapters are selectively removably received in the first binder. A second binder, a personal reference binder, is provided, which is of a size to accept the selectively removed personal reference section pages, and being of a size different from the size of the first binder. A common Table of Contents and a common Index are provided for both of the first and second binders, and refer to the pages in both the first and second binders. By selectively removing personal reference section pages from the first binder, and placing them in the second binder, the user can build up a personalized reference binder (second binder) personal to the user and describing only those features of the equipment which are of interest to the user at that particular time.

2 Claims, 5 Drawing Figures

FIG. 1
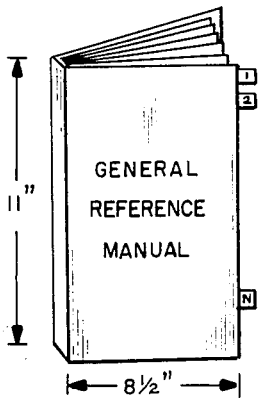
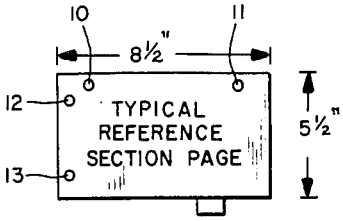
FIG. 4
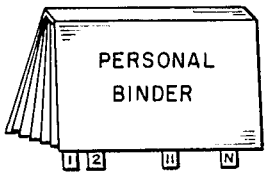
FIG. 5
SCHEMATIC ILLUSTRATION OF CONTENTS OF GENERAL REFERENCE MANUAL
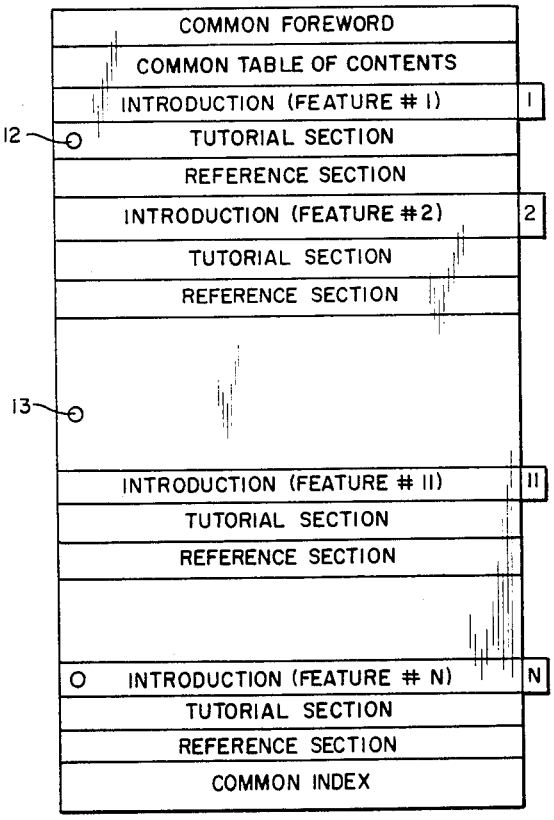
FIG. 2
SCHEMATIC ILLUSTRATION OF CONTENTS OF PERSONAL BINDER
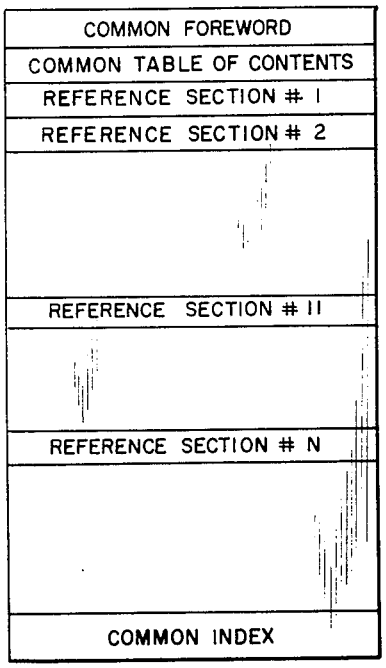
FIG. 3

INSTRUCTION MANUAL AND METHOD OF USING INSTRUCTION MANUAL

BACKGROUND OF THE INVENTION

This invention relates to instruction manuals, and more particularly to a novel instruction manual and method of use thereof.

Instruction manuals of the known type for use with complex multi-function equipment such as electric/electronic typewriters, word processors, computers, etc. are generally relatively voluminous manuals which include much information on the capabilities and use of the equipment involved. Many of these manuals, being large, are quite intimidating to the user, especially a new user of the equipment who then may tend not to use all of the capabilities of the equipment.

The object of the present invention is to overcome the intimidating nature of instruction manuals for relatively complex equipment, such as computers, typewriters, word processors, etc. and to provide a relatively simple to use manual which can be "tailored" to the particular user, and which can be upgraded as the user becomes more familiar with the equipment and more comfortable in operation thereof.

BRIEF DESCRIPTION OF THE DRAWINGS

FIG. 1 schematically illustrates a typical instruction manual according to the present invention;

FIG. 2 illustrates in schematic form the internal contents and arrangement of the instruction manual of the present invention;

FIG. 3 illustrates in schematic form the internal contents and arrangement of the personal reference binder of the present invention;

FIG. 4 illustrates a typical page of the personal reference binder; and

FIG. 5 illustrates the personal reference binder in its assembled state.

SUMMARY OF THE INVENTION

In accordance with one aspect of the invention, in an instruction manual having a plurality of chapters, each chapter having a plurality of sections, the pages of said chapters being arranged in a first binder means of given size, the improvement comprising: at least one of said sections of said chapters comprises a personal reference section made up of pages of different size than the pages of the other sections of said chapters; the pages of said different size personal reference section being selectively removably received in said first binder means; a personal reference binder including a second binder means of a size to accept selectively removed personal reference section pages therein and being of a size different from the size of said first binder means; said personal reference section of each chapter containing practical operational information concerning a feature of equipment to which said instruction manual is directed; and a common Table of Contents and a common Index are provided for the pages in said first and second binder means and referring to the pages in both said first and second binder means; whereby personal reference section pages of selected chapters are selectively removed from said first binder means by a user, as desired by said user, and placed in said second binder means, to build up a personalized reference binder (second binder) personal to the user.

According to another aspect of the invention, the method of carrying out the above is performed.

DETAILED DESCRIPTION

Referring to FIG. 1, an instruction manual according to the present invention is schematically illustrated. Typically, the instruction manual will be printed on $8\frac{1}{2}\times 11$ inch paper, mounted on a conventional way in a three-hole loose leaf binder. Other configurations, however, can be used. This manual is termed the "general reference" manual, and identifies and describes in detail all of the features available on the equipment to which the manual pertains. Preferably, as shown in FIG. 2, each chapter in the general reference manual includes an Introduction, Tutorial and a Reference section. FIG. 2 schematically shows chapters 1, 2 . . . 11, . . . n, by way of example. These three sections of each chapter are preferably color coded, for example, green, red and blue, respectively. All of the pages within each chapter (a chapter deals with a particular aspect of operation) in the general reference manual are numbered sequentially, and are prefixed with either an "I" for Introduction, a "T" for Tutorial, or an "R" for Reference. For example, page number 5R-1 indicates that it is the first page of the Reference section of Chapter 5. This type of numbering will enable the user to place the Reference section of this particular chapter in the proper place in the "personal" or subsidiary reference binder which will be described hereinafter. Because the "personal" reference binder comprises features necessary to begin to use the equipment effectively and those features necessary to the particular user, those features not yet explored or needed by the user will not be included in the "personal" reference binder thereby showing a gap in the page numbering. These gaps in the personal reference binder will serve as a remainder to the user that there are other features available in the equipment which the user may wish to further explore at some time in the future, and perhaps update the equipment.

At the end of each chapter is a "Suggested Reading" list. This list directs the user to other equipment features that complement the feature described in the particular chapter currently being studied and which the user may want to investigate. Once the user is ready to explore the what, the why and the how of other complementary or related features, the general reference manual is read to learn to use each specific other feature.

The main feature of the present invention is the provision of a personally configured manual generated from pages of the general reference manual, hereinafter referred to as the "personal binder". The pages for the "personal binder" are printed on smaller paper than the overall size of the general manual, typically $5\frac{1}{2}\times 8\frac{1}{2}$ inches, as shown in FIG. 4, with two-hole loose leaf binder holes 10,11 (FIGS. 3 and 4) placed therein, for mounting in a two-ring binder as shown in FIG. 5. The Reference sections of the general reference manual are used to build the personalized chapters of the manual, as described below. Preferably, the paper used for the Reference section of the general reference manual is of a heavier stock than that used for other sections thereof. Also, the paper in the Reference section is preferably inserted horizontally and is arranged so as to have three-hole punchings 12,13 (FIG. 4) on one side thereof (for insertion in two rings of a three ring binder) and two-hole punchings on the top side thereof (for mounting in the two-ring binder of the personal binder). The punchings 12,13 in FIG. 4 correspond in spacing to the punchings 12,13 in FIG. 2 which are the top two holes for the 3-ring binder of FIG. 1. When a section is removed from the general manual for inclusion in the personal reference binder, the pages are turned and are arranged in a flip-chart type two-ring binder, as shown in FIG. 5. Each chapter preferably has a clearly marked index tab, as shown in FIGS. 4 and 5, for easy access and reference to a particular chapter.

It is noted that FIGS. 2 and 3 do not illustrate particular pages, but schematically show the contents of the respective binders.

In use, the user will begin by investigating the simpler features and removing the Reference sections from the general manual which relate to the specific features desired to be used. These removed pages are placed into the separate personal reference binder which is smaller than the general reference manual, and which contains more specific information on how to operate the specific features of the equipment. As the user becomes more familiar with the equipment, more features can be explored and learned, and the personal reference binder built up.

Both the general reference binder and the separate personal binder share a common Table of Contents and Index, for ease of reference. For example, when the user desires to locate a Tutorial for a specific feature, or to read further about a specific feature, the user may locate it in the common index (which appears preferably in both the general reference manual and the separate personal binder), and turn to the chapter and page in each of the manuals to study more about the feature. Then the Reference section for the particular feature can be transferred from the general reference manual to the separate personal binder.

Preferably, the "Introductory personal reference binder", which is separate from the general manual, includes selected basic features which cover the basic operation of the equipment involved and enables the user to begin to use the equipment quickly. After reading through the introductory portions, the user should be able to use these features. The other chapters, describing other features, can be read at a pace which is comfortable to the user, depending on the user's capabilities and requirements.

After the user has gained a level of confidence in operating the equipment based upon reading the introductory personal binder, then the user can read about and learn to use some of the other features of the equipment. Many of such other features will not be included in the introductory personal binder. In this case, the user refers to the general reference manual and to the various sections in the appropriate chapter relating to the feature involved. After the user becomes more familiar with the particular feature, the Reference section relating to this particular feature is removed from the general reference manual and is plced into the personal binder. It is noted that only some of the material is included in the Reference section so that the personal binder need not be overly bulky and large. It just contains the information required for everyday use of the particular feature. After the user becomes familiar with this feature, the basic introduction to the feature is not needed any longer, and therefore need not be included in the personal binder of the manual. This is the reason why the introductory section of the general reference manual is on larger size paper than the Reference section, so that the Reference section can be taken out and placed into the smaller personal binder, thereby keeping the personal reference binder at a reasonable workable size. There is never any doubt as to which pages get transferred to the personal binder since they are of a different size, and preferably have different binding holes. As the user progresses with the equipment, the personal reference binder becomes built up until it reaches the point that the personal binder includes all of the features available on the equipment. When this happens, the goal of gradually introducing the user to all of the features of the equipment has been met. As mentioned above, since both sections of the manual have a common index and a common Table of Contents, cross-reference between the two binders is relatively easy and convenient.

While specific dimensions and type of paper (heavy, colored, etc.) are described herein, it should be clear that various other configurations can be used, so long as the Reference sections of the general reference manual are readily distinguishable from the remaining pages of the general reference manual. Preferably, the distinguishing difference between these different sections is by size. Also, while the invention has been described in connection with removing the Reference sections from the general reference manual, other "sections" of the general reference manual could be similarly configured for removal and placement in a separate personal reference binder. While the common Table of Contents and the common Index are preferably provided in both the general reference manual and the separate personal binder, they can be provided in one or the other of the general reference manual and the personal binder, as desired. Further, while loose-leaf binders are described in detail herein, other binders can be used. For example, the general reference manual may have all of its pages except for the Reference pages permanently bound therein, with the Reference section pages being removable therefrom, for example, contained in "pockets" provided for each chapter.

I claim:

1. An instruction manual comprising:

a plurality of chapters, each chapter having a plurality of sections, all the pages of said chapters being arranged in a first loose-leaf binder means of given size;

at least one of said sections of each of said chapters comprises a personal reference section made up of pages smaller than the pages of the other sections of each of said chapters to provide for easier identification of said personal reference section in said first binder means;

the pages of said smaller size personal reference section being selectively removably received in said first loose-leaf binder means so that they can be selectively removed from and re-inserted in said first loose-leaf binder means;

a personal reference binder including a second loose-leaf binder means of a size smaller than said first loose-leaf binder means to accept selectively removed personal reference section pages therein;

said first loose-leaf binder means having rings in a first configuration and said second loose-leaf binder means having rings in a second configuration to avoid confusion therebetween, the pages of said personal reference section of each of said chapters having one edge having ring-receiving openings of said first configuration, and another edge having ring-receiving openings of said second configuration, whereby personal reference section pages which are removed from said first binder means are insertable into said second binder means in a different orientation than in said first binder means;

said personal reference section containing practical operational information concerning a feature of equipment to which said instruction manual is directed; and a common Table of Contents and a common Index for the pages in said first and second binder means referring to the pages in both said first and second binder means;

whereby personal reference section pages are selectively removed from said first binder means by a user, as desired by said user, and inserted into said personal reference binder means, to build up a reference manual personal to the user.

2. A method of preparing and using an instruction manual comprising:

providing a plurality of chapters, each chapter having a plurality of sections, and arranging all the pages of said chapters in a first loose-leaf binder means of given size;

at least one of said section of each of said chapters comprising a personal reference section made up of pages smaller than the pages of the other sections of each of said chapters to provide for easier identification of said personal reference section in said first binder means;

selectively removing pages of said smaller size personal reference section from said first loose-leaf binder means, said removed pages being reinsertable into said first loose-leaf binder means;

inserting said removed pages of said personal reference sections into a loose-leaf binder means of a size smaller than said first loose-leaf binder means;

said first loose-leaf binder means having rings in a first configuration and said personal reference loose-leaf binder means having rings in a second configuration to avoid confusion therebetween, the pages of said personal reference section of each of said chapters having one edge having ring-receiving openings of said first configuration, and another edge having ring-receiving openings of said second configuration, whereby personal reference section pages which are removed from said first binder means are insertable into said personal reference binder means in a different orientation than in said first binder means;

said personal reference section containing practical operational information concerning a feature of equipment to which said instruction manual is directed; and providing a common Table of Contents and a common Index for the pages in both said first and personal reference binder means referring to the pages in both said first and personal reference binder means;

whereby personal reference section pages are selectively removed from said first binder means by a user, as desired by said user, and inserted into said personal reference binder means, to build up a reference manual personal to the user.

* * * * *